US007941089B2

(12) United States Patent
Mori et al.

(10) Patent No.: US 7,941,089 B2
(45) Date of Patent: May 10, 2011

(54) IMAGE FORMING SYSTEM AND CLEAR COATING APPARATUS

(75) Inventors: Akihito Mori, Toride (JP); Nobuo Sekiguchi, Moriya (JP); Tadaaki Saida, Kashiwa (JP); Keita Takahashi, Abiko (JP)

(73) Assignee: Canon Kabushiki Kaisha (JP)

( * ) Notice: Subject to any disclaimer, the term of this patent is extended or adjusted under 35 U.S.C. 154(b) by 1013 days.

(21) Appl. No.: 11/755,883

(22) Filed: May 31, 2007

(65) Prior Publication Data

US 2007/0278730 A1 Dec. 6, 2007

(30) Foreign Application Priority Data

Jun. 1, 2006 (JP) ..... 2006-153666

(51) Int. Cl.
*G03G 15/00* (2006.01)
*B41L 43/10* (2006.01)
*B65H 33/04* (2006.01)

(52) U.S. Cl. ..... 399/408; 270/37; 270/58.09

(58) Field of Classification Search ..... 399/408; 427/284, 285, 288
See application file for complete search history.

(56) References Cited

U.S. PATENT DOCUMENTS

2005/0249574 A1* 11/2005 Honmochi et al. ..... 412/9
2006/0110194 A1* 5/2006 Emmert et al. ..... 399/341

FOREIGN PATENT DOCUMENTS

GB 2 221 190 A 1/1990
JP 03-013079 A 1/1991
JP 2000-177019 A 6/2000
JP 2003-149994 A 5/2003

OTHER PUBLICATIONS

Extended European Search Report issued in corresponding European Patent Application No. 07010801.4 dated Sep. 17, 2010.

* cited by examiner

*Primary Examiner* — Ren Yan
*Assistant Examiner* — Allister Primo
(74) *Attorney, Agent, or Firm* — Rossi, Kimms & McDowell LLP

(57) ABSTRACT

A image forming system that can prevent a toner from coming off while reducing the amount of consumption of a clear toner in binding sheets into a book. An image forming apparatus 100 forms an image on a sheet. A clear coating apparatus 200 forms a clear coating image on the sheet using the clear toner that becomes transparent after fixing. A bookbinding apparatus 600 connected to the image forming apparatus 100 and the clear coating apparatus 200 subjects the sheet to folding process. A job controller 501 and an image controller 502 cause the clear coating apparatus 200 to form the clear toner image at a folding position on the sheet in response to designation of a folding mode in the bookbinding apparatus 600.

5 Claims, 10 Drawing Sheets

IMAGE FORMING SYSTEM AND CLEAR COATING APPARATUS

BACKGROUND OF THE INVENTION

1. Field of the Invention

The present invention relates to an image forming system in which an image forming apparatus which forms an image on a sheet, a clear coating apparatus which forms a clear coating image using a clear toner that becomes transparent after fixing, and a bookbinding apparatus are connected.

2. Description of the Related Art

The demand for improved image quality has been increasing in recent years with respect to full-color electrophotographic image forming apparatuses (image forming apparatuses). In addition, as the use of digital cameras is also increasing in popularity, there is a demand for image modes for a high-image quality photographic tone to be realized in electrophotographic image forming apparatuses.

Image forming systems have been proposed in which an image forming apparatus and a clear coating apparatus are connected. In these systems, after outputting an image having a high-quality photographic tone on a sheet, image forming is further performed to form a toner image that becomes transparent after fixing on the sheet (for example, see Japanese Laid-Open Patent Publication (KOKAI) No. 03-13079).

Further, an image forming system is also known in which a bookbinding apparatus that implements a folding mode and a staple mode in which sheets with images formed thereon are folded to make the sheets into a bound book is connected at a stage following an image forming apparatus.

In the conventional image forming system comprising a bookbinding apparatus, there has been a problem that when a sheet on which a toner image has been fixed is folded at the bookbinding apparatus, the toner comes off at the folding position of the sheet. There has also been a problem that, even when the toner that has been fixed at the folding position does not come off at the time of bookbinding, the user opens or closes the bound sheets or contacts a folding position with some object so that the toner at the folding position comes oft.

When the toner that has been fixed at the folding position comes off, the quality of the binding declines, the appearance becomes poor, and the toner that has come off dirties the area around the bound sheets.

Although a counter measure can be considered in which a toner image is not formed at a sheet folding position in order to solve the above problem, when a toner image is not formed at a folding position on the front cover, in particular, the appearance deteriorates.

Further, although forming a clear coating image using the aforementioned clear toner can also be considered as a counter measure to solve the aforementioned problems, when clear toner is used on the entire surface of a sheet it leads to a waste of the clear toner.

Furthermore, although a counter measure may be considered in which the user specifies a position for image formation using clear toner on each individual sheet, this increases the operation burden of the user.

Further, when performing a process in which the center of sheets is stapled and the sheets are then folded, if a clear coat is applied to all the sheets, there are cases in which the thickness of the center of the sheets increases and thus stapling cannot be accurately performed.

SUMMARY OF THE INVENTION

The present invention provides an image forming system and a clear toner apparatus that can prevent a toner from coming off while reducing the amount of consumption of a clear toner in binding sheets into a book.

Accordingly, in a first aspect of the present invention, there is provided an image forming system, comprising an image forming apparatus adapted to form an image on at least one sheet, a clear coating apparatus adapted to form a clear coating image on the at least one sheet using a clear toner that becomes transparent after fixing, a bookbinding apparatus that is connected to the image forming apparatus and the clear coating apparatus, and that is adapted to subject the at least one sheet to a folding process, and a controller adapted to cause the clear coating apparatus to form a clear coating image at a folding position on the at least one sheet in response to designation of a folding mode in the bookbinding apparatus.

Moreover, in a second aspect of the present invention, there is provided a clear coating apparatus that is connected to a bookbinding apparatus adapted to subject at least one sheet to a folding process, comprising a clear coating unit adapted to form a clear coat on the at least one sheet using a clear toner that becomes transparent after fixing, and a controller is adapted to, when the at least one sheet is subjected to a folding process by the bookbinding apparatus, cause the clear coating unit to form a clear coat at a folding position of the at least one sheet.

According to the present invention, it is possible to form the clear coating image at only the folding position in which the toner fixed tends to come off using the minimum amount of the clear toner without the operation burden of the user. Therefore, it is also possible to prevent the toner from coming off while reducing the amount of consumption of the clear toner in binding sheets into the book.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
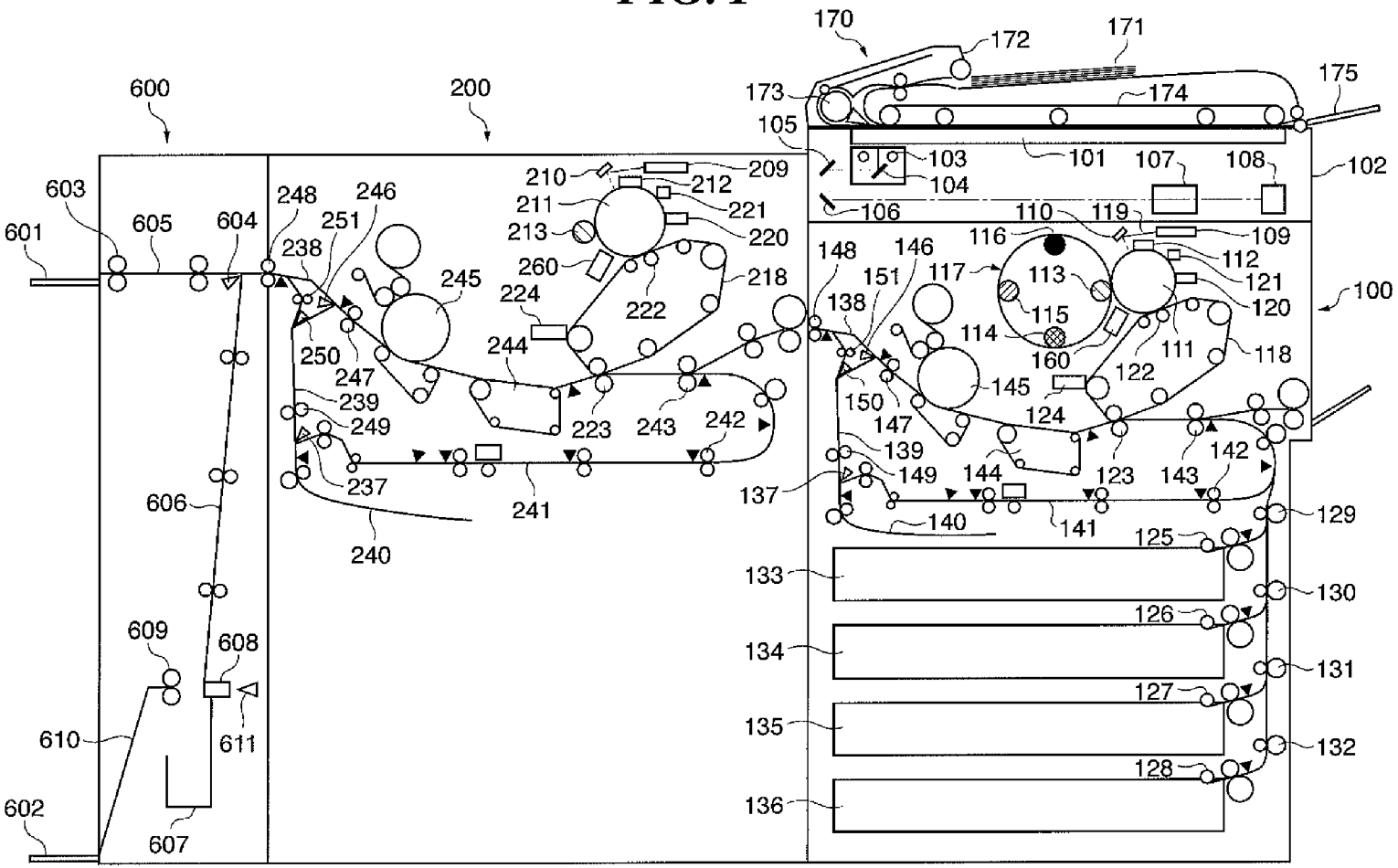
FIG. 1 is a view that schematically shows the configuration of an image forming system according to an embodiment of the present invention.

FIG. 1 is a view that schematically shows the configuration of an image forming system according to an embodiment of the present invention.

In FIG. 1, the image forming system comprises an image forming apparatus 100, a clear coating apparatus 200 connected at the stage subsequent thereto, and a bookbinding apparatus 600 connected at the stage following the clear coating apparatus 200. In the present embodiment, although a color image forming apparatus is described as an example of the image forming apparatus 100, the image forming apparatus 100 may be a monochrome image forming apparatus.

The image forming apparatus 100 is comprised of a platen glass 101 as an original placement stage and a scanner 102. The scanner 102 comprises an original illuminating lamp 103, scanning mirrors 104 to 106, a lens 107, and an image sensor section 108 and the like.

The lamp 103 and the scanning mirror 104 moves back and forth in a predetermined direction by an unshown motor. A light that is reflected from an original during the moving back and forth passes through the lens 107 via the scanning mirrors 104 to 106 to form an image on a CCD sensor inside the image sensor section 108.

An exposure controller 109 comprises a laser and a polygon scanner and the like. The exposure controller 109 reflects a laser light 119 that has been modulated on the basis of an image signal that has been converted to an electrical signal by the image sensor section 108 and also subjected to a predetermined image processing, described later, using a return mirror 110 to irradiate the laser light 119 on a photosensitive drum 111. A detailed description of the exposure controller of the image forming apparatus will be given later using FIG. 3.

Around the periphery of the photosensitive drum 111 are disposed a pre-exposure lamp 121 for eliminating electric potential of the photosensitive drum 111 and a primary charger 112 that produces a corona discharge by applying a high voltage to a wire in order to load an electric potential on the photosensitive drum 111.

Further, a developing rotary 117, an intermediate transfer member 118 that temporarily retains an image that has been developed on the photosensitive drum 111, a primary transfer roller 122 that transfers an image onto the intermediate transfer member 118, and a photosensitive drum cleaner 120 are also disposed around the periphery of the photosensitive drum 111.

A plurality of developing devices 113 to 116 which are filled with toner of respectively different colors are housed inside the developing rotary 117 that is moved so that each of the developing devices 113 to 116 comes in contact with the photosensitive drum 111 in sequence.

The photosensitive drum 111 is rotated by an unshown motor, and after being charged to a desired potential by the primary charger 112, the angle of the laser light 119 from the exposure controller 109 is changed to the direction toward the photosensitive drum 111 by the return mirror 110 to irradiate the laser light 119 onto the photosensitive drum 111. Thereby, an electrostatic latent image is formed on the photosensitive drum 111.

The developing device 113 for the first color is moved by the developing rotary 117 to bring the developing device 113 into contact with the photosensitive drum 111 and electrostatically attach toner from inside the developing device 113 to the electrostatic latent image to form a toner image on the photosensitive drum 111.

When forming a full color image with the toners inside the respective developing devices 113 to 116 with four colors that are housed in the developing rotary 117, the toner image of the first color that is developed on the photosensitive drum 111 is primarily transferred onto the intermediate transfer member 118 by the primary transfer roller 122. Thereafter, the developing device 114 for the second color is brought in contact with the photosensitive drum 111 by the developing rotary 117.

At this time, at a timing at which the front end of the toner image of the first color that has been transferred onto the intermediate transfer member 118 and the front end of an electrostatic latent image for a second color to be developed on the photosensitive drum 111 completely match at a position on the primary transfer roller 122, the laser light 119 from the exposure controller 109 is again irradiated toward the photosensitive drum 111.

The electrostatic latent image of the second color is developed by the developing device 114 for the second color in the same manner as the electrostatic latent image of the first color. The toner image of the second color is then superimposed on the toner image of the first color that has been primarily transferred onto the intermediate transfer member 118. By repeating this superimposing operation for the third color and fourth color, a four-color full color toner image is formed on the intermediate transfer member 118.

Meanwhile, a sheet is fed respectively by pickup rollers 125, 126, 127, and 128 from a first sheet feeding cassette 133, a second sheet feeding cassette 134, a third sheet feeding cassette 135 or a fourth sheet feeding cassette 136. The sheet that is fed is conveyed toward a registration roller 143 by sheet feeding rollers 129, 130, 131, and 132.

A sheet that is conveyed as far as the vicinity of the registration roller 143 that is stopped is conveyed to a secondary transfer roller 123 by the registration roller 143 being driven so that the front end of the toner image that is formed on the intermediate transfer member 118 and the front end of the sheet match. A transfer bias is then applied to the secondary transfer roller 123 so that the toner image that is formed secondary transferred onto the sheet. Thereafter, the sheet is conveyed by a conveying belt 144.

Residual toner that has not been secondary transferred onto the sheet by the secondary transfer roller 123 remains on the intermediate transfer member 118. This residual toner is cleaned by an intermediate transfer member cleaner 124. The intermediate transfer member cleaner 124 can move freely, and contacts against the intermediate transfer member 118 immediately prior to the front end of the residual toner of the secondary transferred image arriving at the intermediate transfer member cleaner 124.

The toner image of the next color is then primary transferred onto the intermediate transfer member 118 by the primary transfer roller 122. Immediately prior to the front end of that toner image arriving the intermediate transfer member cleaner 124, control is performed to separate the intermediate transfer member cleaner 124 from the intermediate transfer member 118.

Other residual toner also remains on the photosensitive drum 111 from which the image has been primary transferred onto the intermediate transfer member 118. This other residual toner is cleaned by a photosensitive drum cleaner 120. Thereafter, a residual charge of the photosensitive drum 111 is removed by the pre-exposure lamp 121.

A sheet onto which the image has been transferred from the intermediate transfer member 118 is conveyed to a fixing device 145 by the conveying belt 144. The fixing device 145 comprises an upper heat roller and a fixing belt that applies a fixing pressure from below. The toner image that has been transferred onto the sheet is pressured and heated by the fixing device 145 and thereby fixed to the sheet. Thereafter, the sheet is discharged to outside the image forming apparatus 100 by internal discharge rollers 147 and external discharge rollers 148.

Further, in FIG. 1, a discharge flapper 146 switches the route of the sheet to either a conveying path 138 or an inverting path 139. When performing double-sided recording (double-sided copying) in which images of both sides of a sheet are formed, by raising the discharge flapper 146 upward, a sheet that is fed from the internal discharge rollers 147 is guided to the inverting path 139 to be conveyed to a double-sided inversion conveying path 140.

Thereafter, by switching the flapper 137 to reverse the transporting direction, the sheet is guided to a sheet re-feeding path 141 in a state in which the sheet has been turned upside down. At the front end of the sheet re-feeding path 141 are provided sheet re-supply rollers 142 that re-feeds the sheet to an image formation position (transfer position).

The external discharge rollers 148 are disposed in the vicinity of the discharge flapper 146. The external discharge rollers 148 discharge to outside the image forming apparatus 100 a sheet whose route has been switched to the conveying path 138 by the discharge flapper 146. When inverting and discharging a sheet from the image forming apparatus 100, the discharge flapper 146 is raised upward and the sheet is fed to the inverting path 139 as far as a position at which the trailing end of the sheet has passed through an inversion flapper 150 by an inversion roller 149. Thereafter, by switching the inversion flapper 150 and reversing the rotation of the inversion roller 149, the sheet is turned upside down and fed out to the side of the external discharge rollers 148.

An automatic document feeder (ADF) 170 automatically feeds an original as far as a position at which the document can be read by the scanner 102.

The ADF 170 comprises an original placement tray 171 on which a maximum of 100 sheets of originals can be placed, an original feed roller 172 for feeding originals, a double-sided original inverting roller 173 for reading both sides of an original that is fed from the original feed roller 172, and an original conveying belt 174.

The original conveying belt 174 conveys an original that is conveyed from the original feed roller 172 or the double-sided original inverting roller 173 onto the platen glass 101. The original conveying belt 174 stops the original at a reading position, and when reading the rear surface of an original, control is performed to return the original to the double-sided original inverting roller 173 and discharge the original onto an original discharge tray 175. The maximum number of sheets that can be stacked on the original discharge tray 175 is 100 or more, similarly to the original placement tray 171.

In the clear coating apparatus 200, each unit that is denoted by a reference numeral in the two hundreds has function similar to the respective unit that is denoted by a reference numeral in the one hundreds in the image forming apparatus 100, and a duplicate description of those units is omitted here.

A detailed description of an exposure controller 209 of the clear coating apparatus 200 is given later with reference to FIG. 4. A developing device 213 is filled with a clear toner. Although the clear toner originally has a whitish color, it becomes transparent upon application of heat by a fixing device.

A sheet on which an image has been formed by the image forming apparatus 100 is conveyed into the clear coating apparatus 200 by the external discharge rollers 148. The sheet is passed between rollers inside the clear coating apparatus 200 to convey the sheet toward a registration roller 243. The subsequent image forming operations and conveying and discharge operations are the same as those of the image forming apparatus 100.

A sheet that is discharged from external discharge rollers 248 of the clear coating apparatus 200 is conveyed to the bookbinding apparatus 600. When a folding mode is not designated, a switching flapper 604 is set to a direction in which the sheet is conveyed to a straight conveying path 605. After passing through the switching flapper 604, the sheet is discharged to outside the apparatus by sheet discharging rollers 603 via the straight conveying path 605 and stacked on a first discharge tray 601.

When the folding mode is designated, the switching flapper 604 is set to a direction in which the sheet is conveyed to a fold conveying path 606. After passing through the switching flapper 604, the sheet is stored in a primary stack 607 via the fold conveying path 606. Upon a plurality of sheets being stored, a push-out mechanism 611 moves in the direction of folding rollers 609, and the stored sheets are pushed out to the folding rollers 609 while the center of the stored sheets is being pushed by the push-out mechanism 611, to thereby fold the sheets at the center in the sub-scanning direction using the folding rollers 609.

In this case, the primary stack 607 can move up and down in accordance with the sheet size so as to fold sheets at the center thereof in the sub-scanning direction. Sheets that are folded by the folding rollers 609 are stacked on a second discharge tray 602 via a conveying path 610. When a staple mode is designated in addition to the folding mode, sheets can be stapled at the center in the sub-scanning direction by a staple mechanism 608. A bookbinding image that is output in the folding mode of this bookbinding apparatus 600 is described later.

Figure 2:
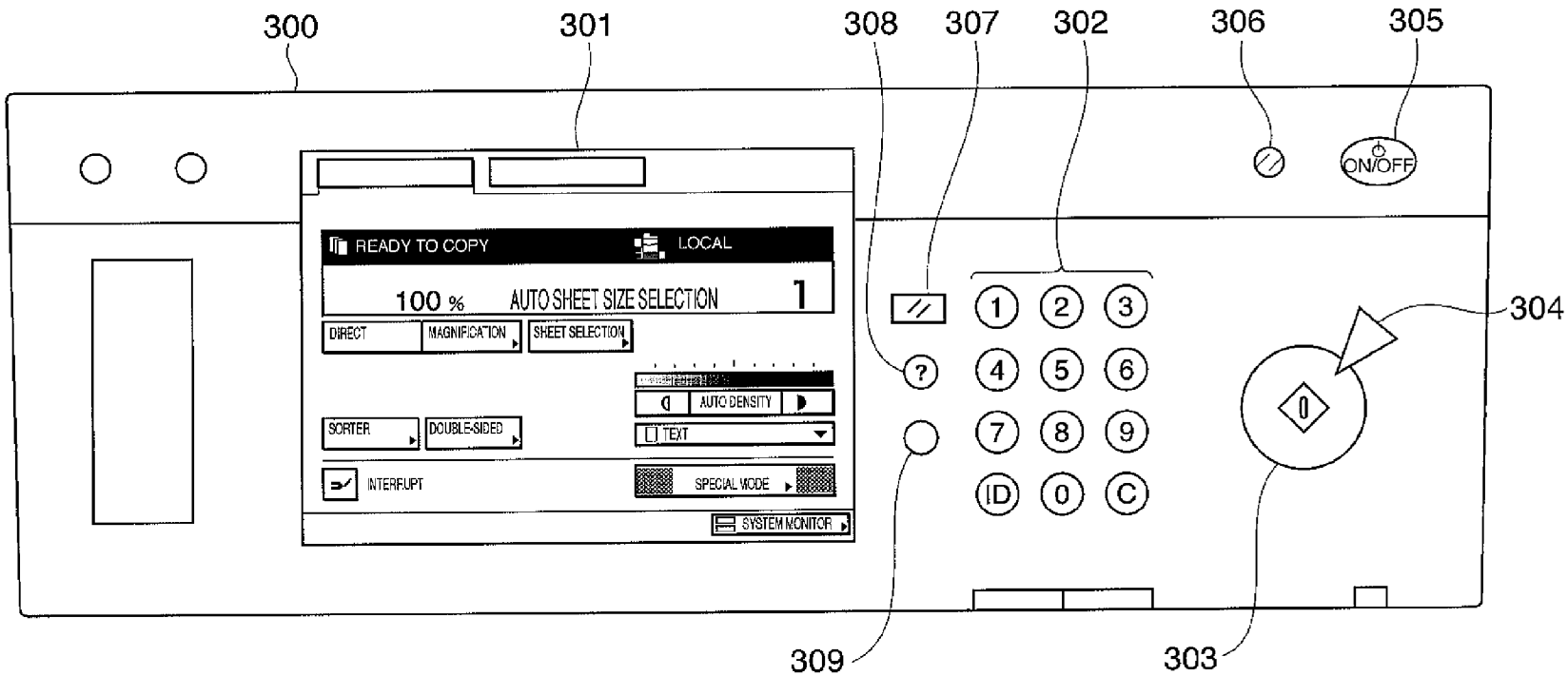
FIG. 2 is a view showing an operation panel of the image forming apparatus in FIG. 1.

FIG. 2 is a view showing the operation panel of the image forming apparatus shown in FIG. 1.

In FIG. 2, an operation panel 300 comprises an LCD display 301, ten keys 302, a start key 303, a stop key 304, a soft power key 305, an energy saving mode key 306, a reset key 307, a guide key 308, and a user mode key 309.

The touch panel type LCD display 301 is used to set the mode and display the status of the image forming apparatus 100. The ten keys 302 comprise input keys for the numbers from 0 to 9 and a clear key for returning the settings to a default value. The start key 303 is pressed when executing a copy function or a scan function or the like.

The stop key 304 is a key which the user presses when the user wants to stop a copy function job, a print function job, a scan function job or the like. The soft power key 305 is a key that is used when the user want to shut down the electric power of each load such as a motor of the image forming apparatus 100, but wants to keep a CPU or a network activated.

The energy saving mode key 306 is a key which the user presses in order to have heat regulation control of the fixing device 145 performed at a level that is set in the user mode. The reset key 307 is a key for resetting to a default value a function that has been set using the LCD display 301 or the ten keys 302.

The guide key 308 is a key for displaying a description of the copy functions, print functions, and scan functions that are set on the LCD display 301. The guide key 308 is also used to display a description of each user mode that is displayed using the user mode key 309 to be set or executed.

The user mode key 309 is used to set default value for each function of the image forming apparatus 100 or to set an adjustment mode in which are executed adjustment items such as tone correction that the user can arbitrarily perform, and also to perform various network settings such as setting an IP address.

By using the operation panel 300 a user can designate an operating mode such as a single-sided clear coating mode or a double-sided clear coating mode.

Figure 3:
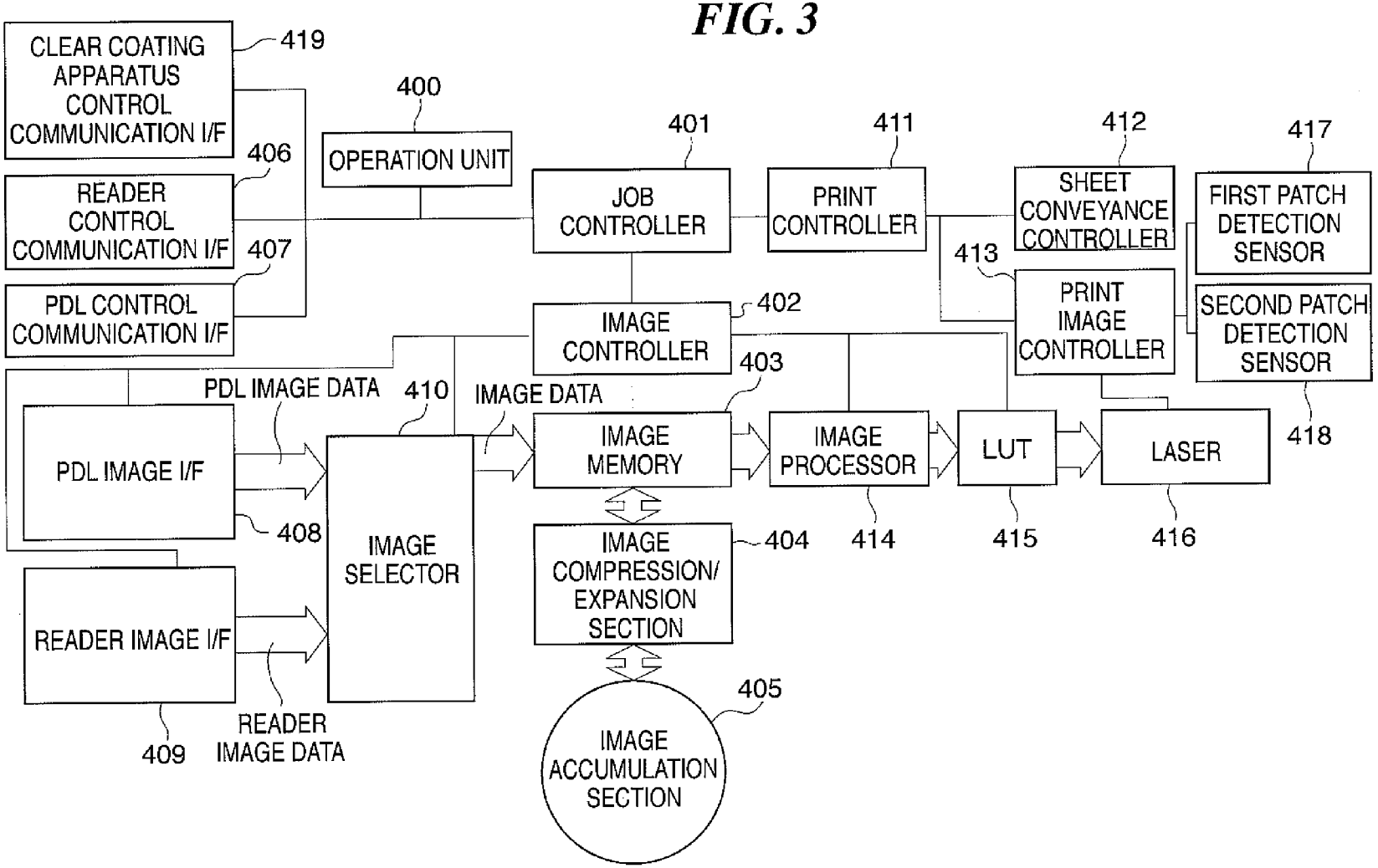
FIG. 3 is a view that schematically shows the circuitry of the image forming apparatus shown in FIG. 1.

FIG. 3 is a view that schematically shows the circuitry of the image forming apparatus shown in FIG. 1.

In FIG. 3, an operation unit 400 is a circuit for controlling an operation panel 300 shown in FIG. 2. A job controller 401 is a circuit that includes a ROM in which programs for controlling the image forming apparatus 100 are written, a RAM in which programs are loaded, and a CPU for executing those programs or the like.

The operation unit 400 is connected to the job controller 401. An instruction that is output by the operation unit 400 is notified to the job controller 401. A copy job or scan job or the like that corresponds to the operation mode that is notified is generated by a program of the job controller 401.

The job controller 401 is also connected to a reader control communication I/F 406 that is a communication I/F for an unshown CPU circuit that controls a scanner 102 that reads an original image, and a clear coating apparatus control communication I/F 419 that is responsible for control of the clear coating apparatus 200.

Further, the job controller 401 is connected to a PDL control communication I/F 407 that is a communication I/F for a CPU circuit of an unshown PDL image controller that loads PDL image data that is sent from an unshown personal computer or the like as a bit map image.

The job controller 401 is also connected to an image controller 402 that controls image data in order to send a PDL image or a reader image to each developing station of the image forming apparatus 100, and a print controller 411 that performs drive control of each load to form an image. More specifically, the job controller 401 is responsible for overall control of the image forming apparatus 100.

The image controller 402 is a circuit that sets each image-related circuit in accordance with a job that is generated by the job controller 401. According to the present embodiment, PDL image data from the PDL image I/F 408 or reader image data from the reader image I/F 409 is sent to the image controller 402.

Further, the image controller 402 sets an image selector 410 that decides which of image data to be activated in an image memory 403 comprising a volatile memory, and sets which region the image data from the image selector 410 is to be stored in with respect to the image memory 403.

The image controller 402 also performs setting of an image accumulation section 405 that comprises a nonvolatile memory that is typified by a HDD, and performs settings to compress bitmap image data from the image memory 403 and send the compressed bitmap image data to the image accumulation section 405. Furthermore, the image controller 402 performs setting of an image compression/expansion section 404 that expands compressed image data from the image accumulation section 405 and returns the data to the image memory 403 again.

Further, in order to actually develop and print out image data, the image controller 402 reads out color image data from the image memory 403 and performs desired image processing at an image processor 414. The print controller 411 receives each image data of each color that is finally sent from the print image controller 413 in accordance with each setting of the image controller 402 that is set using the instructed details from the job controller 401, and sends instructions to the print image controller 413. The print image controller 413 sends the image data to lasers 416 for each color.

The print image controller 413 also performs setting of an LUT (Look Up Table) 415 in which sensitivity characteristics with respect to the photosensitive drum 111 of the image data are reflected in accordance with instructions from the print controller 411.

When the density of an image does not become a desired density because of a change in the sensitivity characteristics of the photosensitive drum 111 or because of a change in a laser exposure amount or a charge amount from the primary charger 112 or the like, the LUT 415 changes the image density of the input image data so that the desired density is output. Image data that passed through the LUT 415 for each color is output to the lasers 416 to form electrostatic latent images on the photosensitive drum 111 using the respective developing devices 113 to 116.

Further, the print controller 411 carries out control to synchronize the print image controller 413 with respect to a sheet conveyance controller 412, and transfer a toner image of all the colors that is formed on the intermediate transfer member 118 onto a sheet that is fed from one of the sheet feeding cassettes 133 to 136 to perform printing. The print controller 411 also carries out control to form the image on the sheet using the fixing device 145. A first and a second patch detection sensor 417 and 418 are connected to the print image controller 413.

Figure 4:
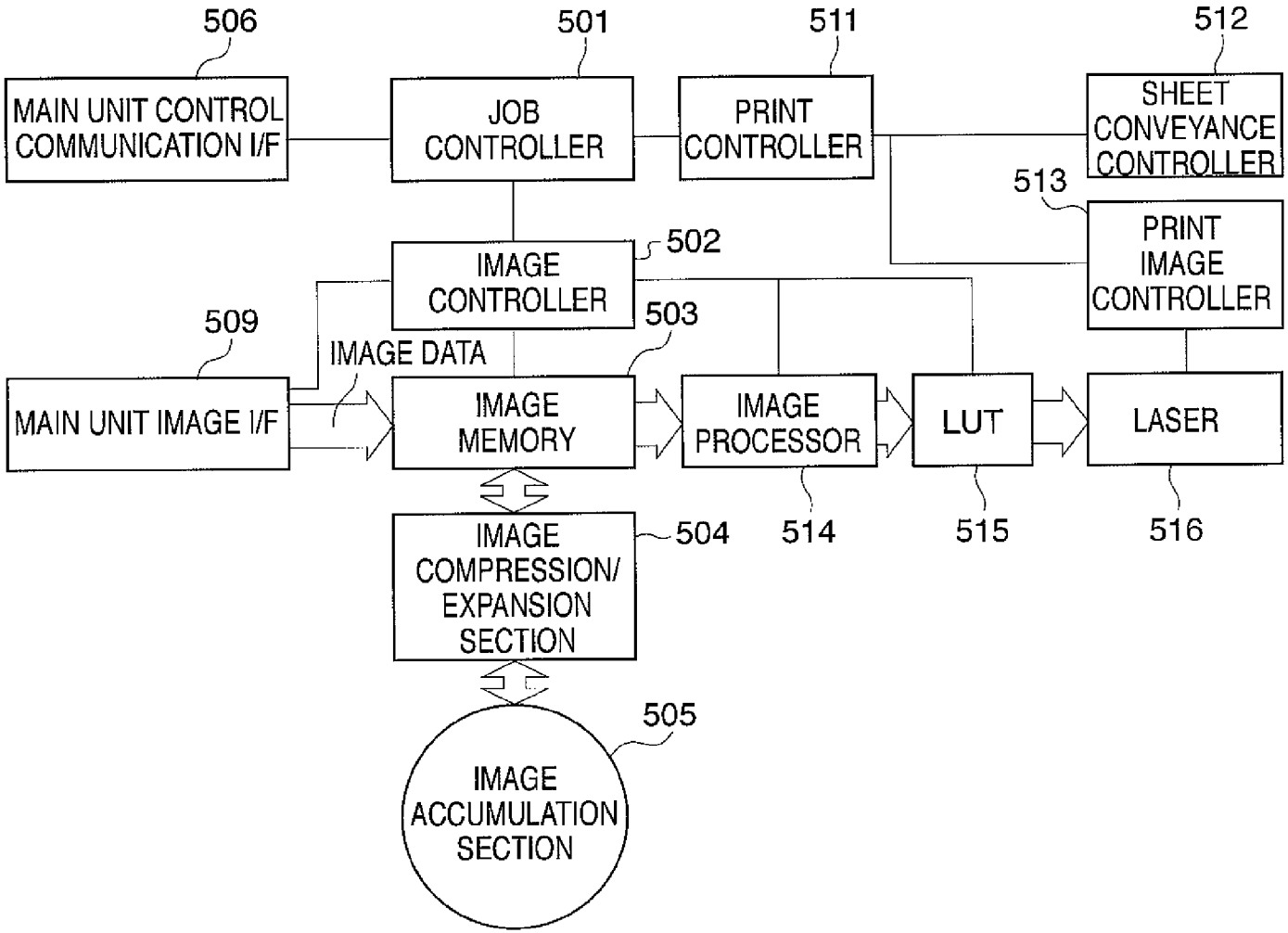
FIG. 4 is a view that schematically shows the circuitry of a clear coating apparatus shown in FIG. 1.

FIG. 4 is a view that schematically shows the circuitry of the clear coating apparatus shown in FIG. 1.

In FIG. 4, a job controller 501 is a circuit that includes a ROM in which programs for controlling the clear coating apparatus 200 are written, a RAM in which programs are loaded, and a CPU for executing those programs or the like.

A main unit control communication I/F 506 is connected to the job controller 501. Details that are instructed from the main unit (image forming apparatus 100) are notified to the job controller 501 through the main unit control communication I/F 506.

A single-sided clear coating operation or a double-sided clear coating operation or the like is performed in accordance with a notified operation mode by a program in the job controller 501. The job controller 501 is connected with an image controller 502 and a print controller 511 that performs drive control of each load to form an image.

The image controller 502 loads image data that is sent from the main unit through a main unit image I/F 509 as a bitmap image. Further, the image controller 502 is a circuit that sets each image-related circuit in accordance with a job that is generated by the job controller 501. According to the present embodiment, image data that is sent to the image controller 502 from the main unit image I/F 509 is stored in an image memory 503.

The image controller 502 also performs setting of an image accumulation section 505 that comprises a nonvolatile memory that is typified by a HDD, and performs settings to compress bitmap image data from the image memory 503 and send the compressed bitmap image data to the image accumulation section 505. Further, the image controller 502 performs setting of an image compression/expansion section 504 that expands compressed image data from the image accumulation section 505 and returns the data to the image memory 503 again. In order to actually develop and print out image data, the image controller 502 reads out clear coating image data from the image memory 503 and performs desired image processing by an image processor 514.

The print controller 511 receives each image data of each color that is finally sent from the print image controller 513 in accordance with each setting of the image controller 502 that is set using the instructed details from the job controller 501, and sends instructions to the print image controller 513.

The print image controller 513 performs setting of an LUT 515 in which sensitivity characteristics with respect to a photosensitive drum 211 of the image data are reflected in accordance with instructions from the print controller 511. When the density of an image does not become a desired density because of a change in the sensitivity characteristics of the photosensitive drum 211 or because of a change in a laser exposure amount or a charge amount from a primary charger 212 or the like, the LUT 515 changes the image density for the image data that is input so that the desired density is output. Image data that passed through the LUT 515 for each color is output to a laser 516 to form an electrostatic latent image on the photosensitive drum 211 using a developing device 213.

The print controller 511 carries out the following control with respect to a sheet conveyance controller 512. Namely, the print controller 511 carries out control to synchronize the sheet conveyance controller 512 with the print image controller 514, transfer a clear coating image that has been formed on an intermediate transfer member 218 onto a sheet that is conveyed from the image forming apparatus 100 to perform printing, and fix the image on the sheet using a fixing device 245.

Hereunder, details of clear coating operations in a folding mode are described.

For convenience, it is assumed that an image that is formed by the image forming apparatus 100 is a one-sided uniform image.

<Example with Image Transfer>

Figure 5A:
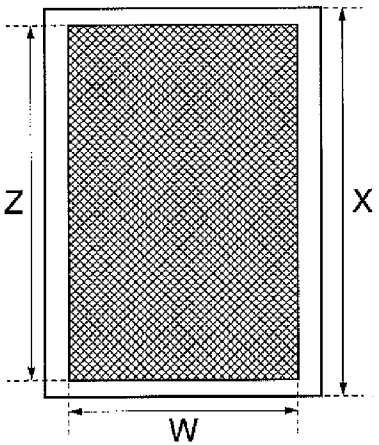
FIG. 5A is a view showing the area of an image formed by the image forming apparatus shown in FIG. 1.

When a mode that includes a folding mode (in this case, a mode in which sheets are folded at the center in the sub-scanning direction is assumed) is designated from the operation unit 400, as shown in FIG. 5A, an image that is uniform over the entire surface of a sheet excluding a margin portion is placed on the sheet by the image forming apparatus 100. For a given sheet, the sub-scanning sheet length of the sheet is taken as X, a sub-scanning image length that excludes margin portions in the sub-scanning direction is taken as Z, and a main-scanning image length that excludes margin portions in the main-scanning direction is taken as W.

Figure 5B:
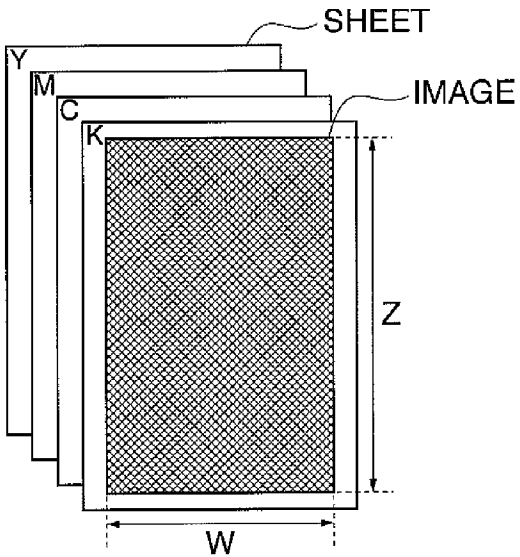
FIG. 5B is a view illustrating expansion into images of four colors by the image forming apparatus shown in FIG. 1.

As shown in FIG. 5B, images of the four colors of Y, M, C, and K are expanded by the image forming apparatus 100. In this case, although in order to explicitly show an image of margins it appears as though a plurality of virtual sheets exist in the drawing, there is only one actual sheet.

Figure 5C:
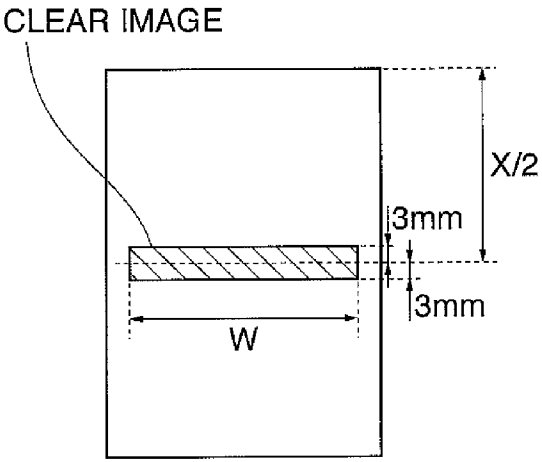
FIG. 5C is a view showing clear coating image data that is created by the clear coating apparatus shown in FIG. 1.

When expanding the images of the four colors Y, M, Cr and K, in order to create clear coating image data as shown in FIG. 5C, a position X/2 from the sheet edge that is the center of the sub-scanning sheet length X is taken as the center, and a sub-scanning image is formed from X/2−3 mm to X/2+3 mm. A main-scanning image length W in this sub-scanning image is the same as the main-scanning image length W for the YMCK image.

An instruction to form a clear coating image is transferred from the image forming apparatus 100 to the job controller 501 of the clear coating apparatus 200 through the main unit control communication I/F 506. Further, clear coating image data for forming a clear coating image is transferred to the image controller 502 and the image memory 503 of the clear coating apparatus 200 through the main unit image I/F 509.

Through the above described operations, a sheet on which the four colors of Y, M, C, and K have been printed (formed an image) (images of the four colors as shown in FIG. 5B have been superimposed) is output from the image forming apparatus 100. At the clear coating apparatus 200, the clear coating image shown in FIG. 5C is formed on the sheet that has been output from the image forming apparatus 100. The sheet that is output from the clear coating apparatus 200 bears an image on which a clear coating image has been placed in an area corresponding to ±3 mm around the center of the sheet as shown in FIG. 6B.

<Example without Image Transfer>

Figure 7A:
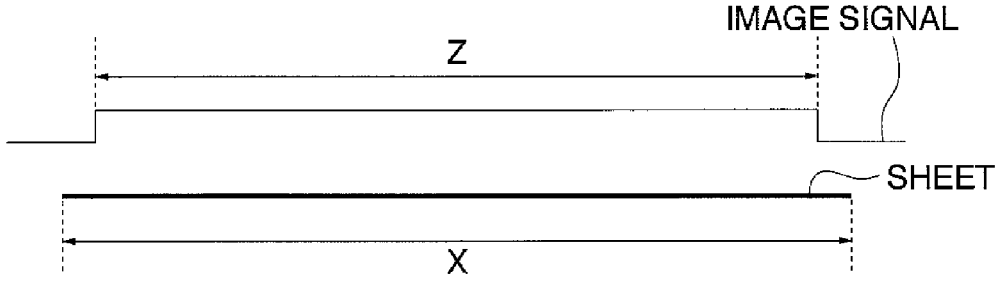
FIG. 7A is a view illustrating an image signal that is generated by the image forming apparatus shown in FIG. 1.

In order to place an image that is uniform over the entire surface excluding a margin portion on a sheet, as shown in FIG. 7A, in the image forming apparatus 100, an image signal having the same density level for a section of a sub-scanning image length Z obtained by excluding a margin portion from the sub-scanning sheet length X of the sheet is generated. Formation of an electrostatic latent image is performed with the laser 416 based on this image signal, and by transferring and fixing the image onto the sheet, an image is formed on the sheet as shown in FIG. 7B.

In this case, when a mode that includes a folding mode (in this case, a mode in which an A3 size sheet is folded at the center in the sub-scanning direction thereof is assumed) is designated from the operation unit 400, an instruction is sent to the clear coating apparatus 200 from the image forming apparatus 100 through the main unit control communication I/F 506.

More specifically, an instruction to form a clear coating image in the vicinity (in this case, taken as ±3 mm) of the center position in the sub-scanning direction for a sheet size X and an image size W in a direction that is not related to folding (in this case, the main-scanning direction) is sent to the job controller 501.

Figure 6A:
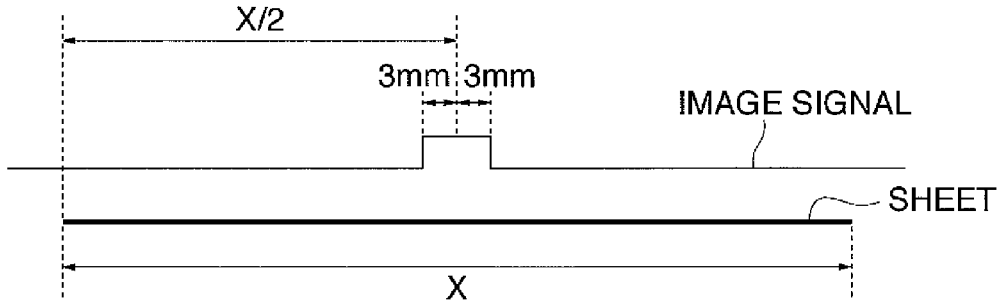
FIG. 6A is a view illustrating an image signal that is generated by the clear coating apparatus shown in FIG. 1.
Figure 6B:
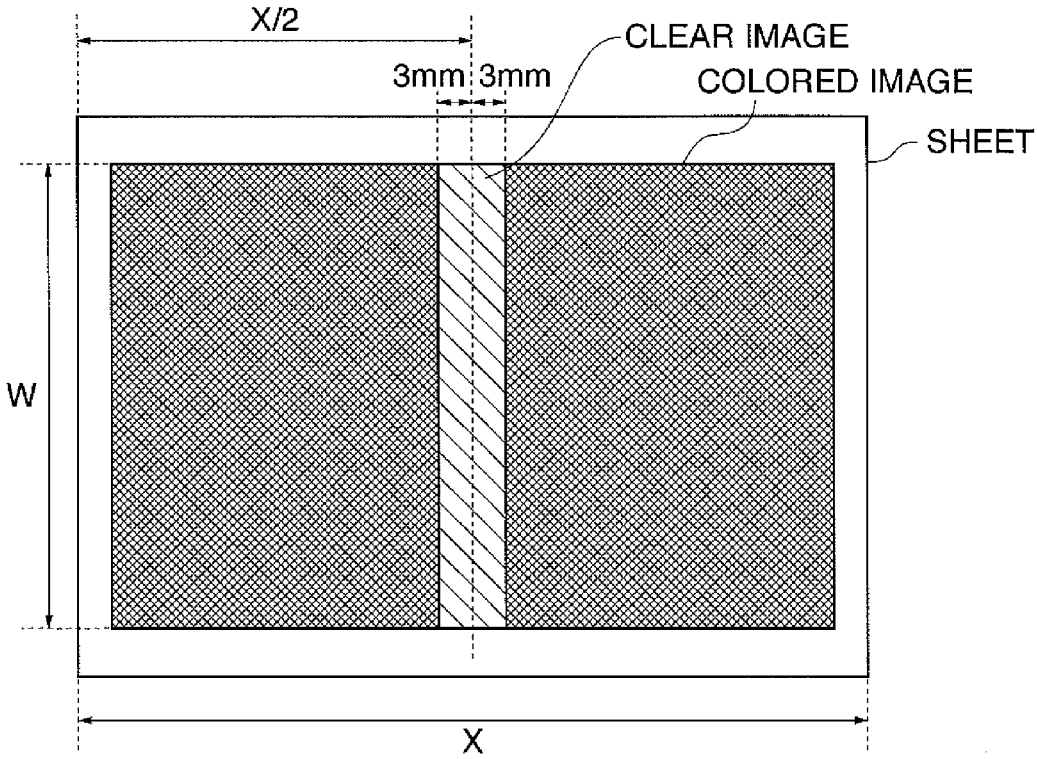
FIG. 6B is a view illustrating a clear coating image that is formed by the clear coating apparatus shown in FIG. 1.
Figure 7B:
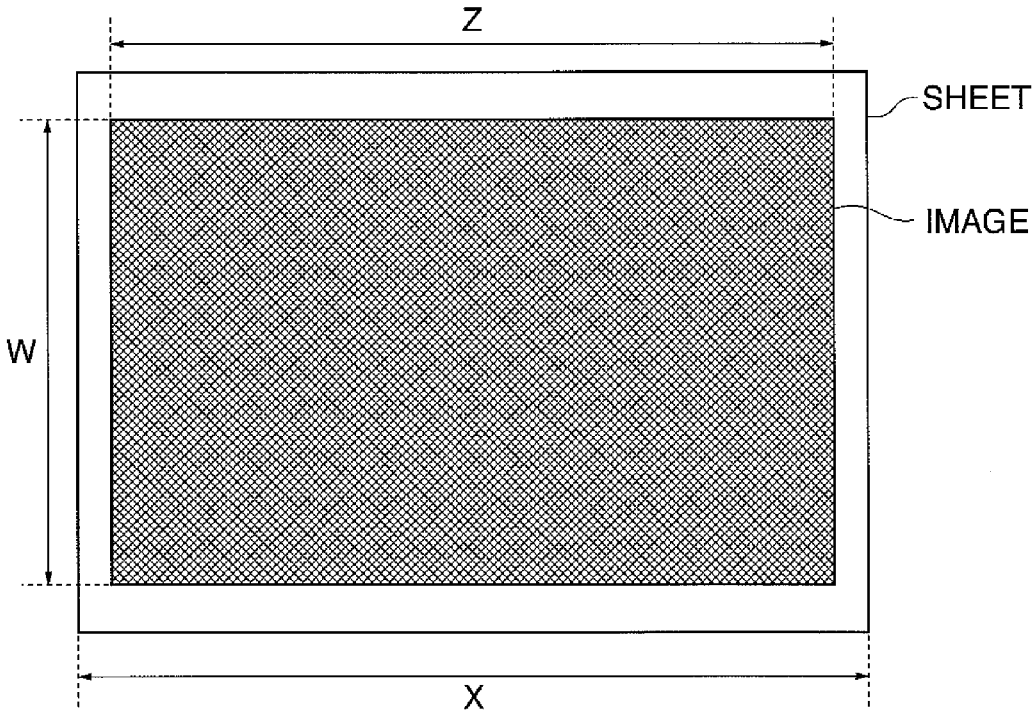
FIG. 7B is a view illustrating an image that is formed by the image forming apparatus shown in FIG. 1.

According to the above described operations, in the clear coating apparatus 200, for a sheet with an image as shown in FIG. 7B that has been printed out at the image forming apparatus 100, a clear coating image of a width of ±3 mm in the sub-scanning direction is formed at the center position of the sheet size X as shown in FIG. 6B.

More specifically, an image signal as shown in FIG. 6A is generated so as to form a clear coating image in a section from a position at X/2−3 mm to X/2+3 mm with respect to a sheet that has been output from the image forming apparatus 100, and image formation is performed with a laser based on this signal. The sheet that is output from the clear coating apparatus 200 will bear an image that has a clear coating image thereon at an area of ±3 mm around the center as shown in FIG. 6B.

Figure 8A:
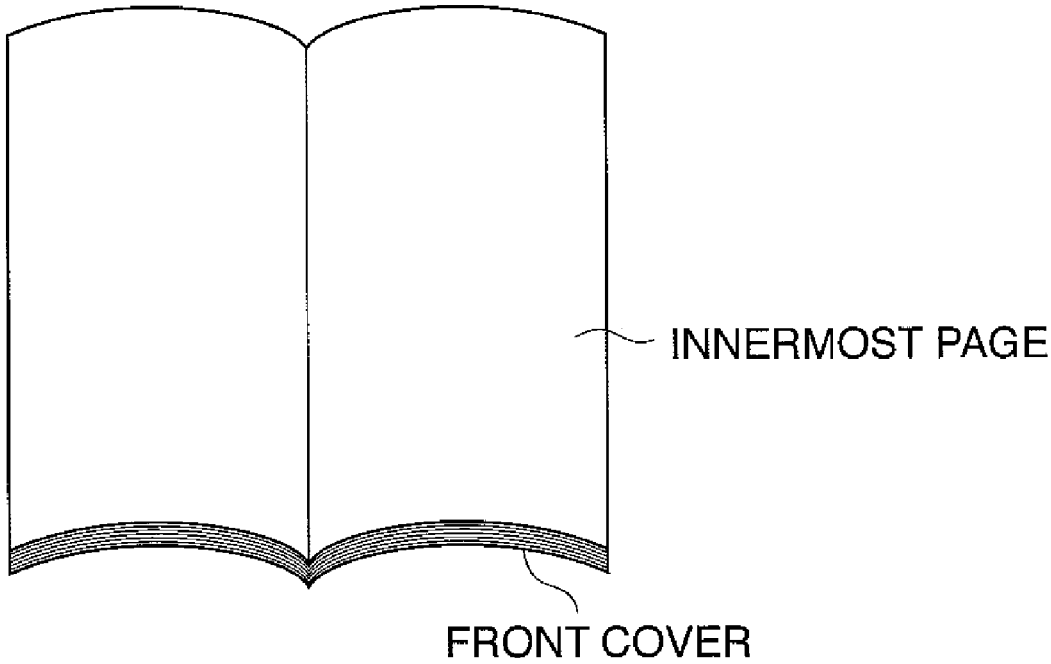
FIG. 8A is a view showing a book that is bound by the bookbinding apparatus shown in FIG. 1.
Figure 8B:
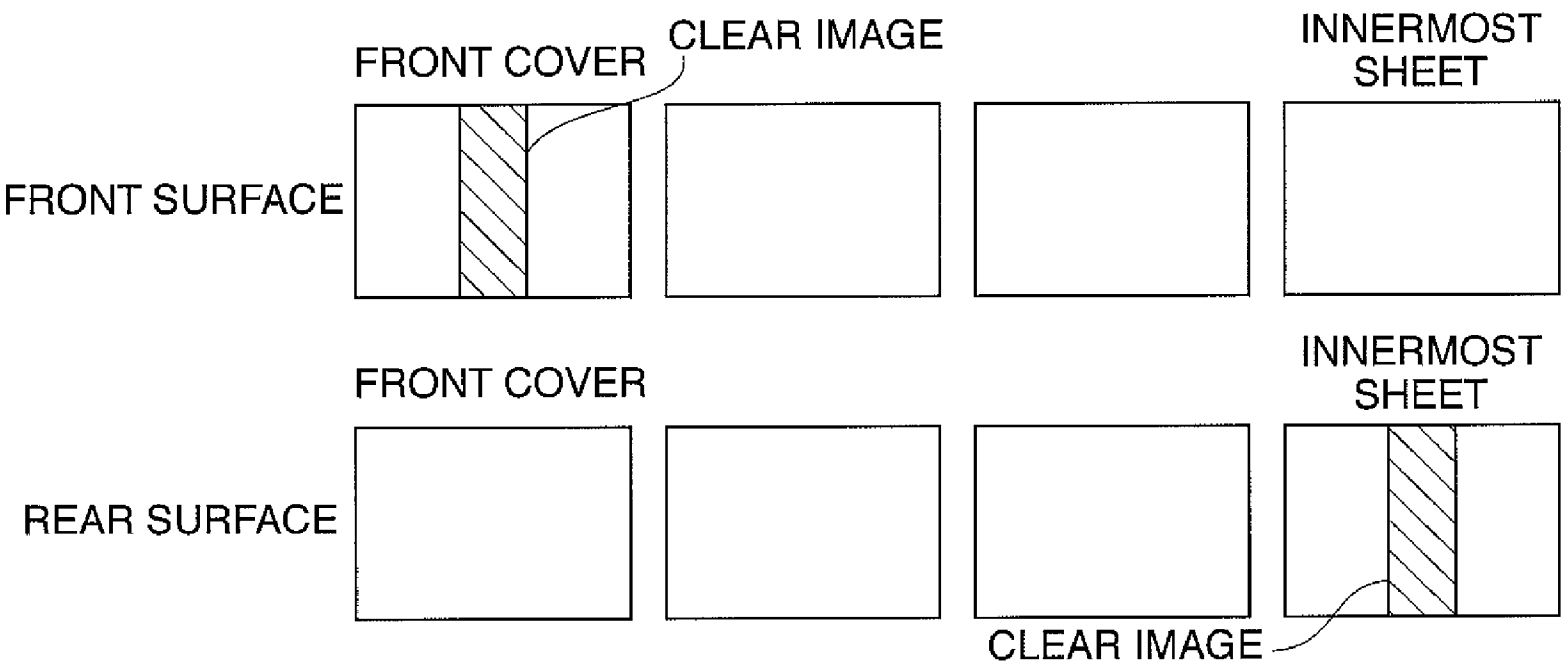
FIG. 8B is a view showing clear coating images to be printed on the book shown in FIG. 8A.

In the case of binding a book including four sheets, as shown in FIG. 8A, clear coating images are respectively formed on the outer side of the front cover and the inner side of the innermost sheet of the bound book. When the outer side of the front cover is taken as the front surface, as shown in FIG. 8B, clear coating images are respectively printed on two pages consisting of the surface of the front cover and the rear surface of the innermost sheet.

In this case, a clear coating image is formed in an area of ±3 mm at the center in the sub-scanning direction on each of a sheet that is output first from the image forming apparatus 100 and a sheet that is output last from the image forming apparatus 100. Accordingly, the job controller 501 performs scheduling so as to form clear coating images respectively on the first and last pages.

Figure 9:
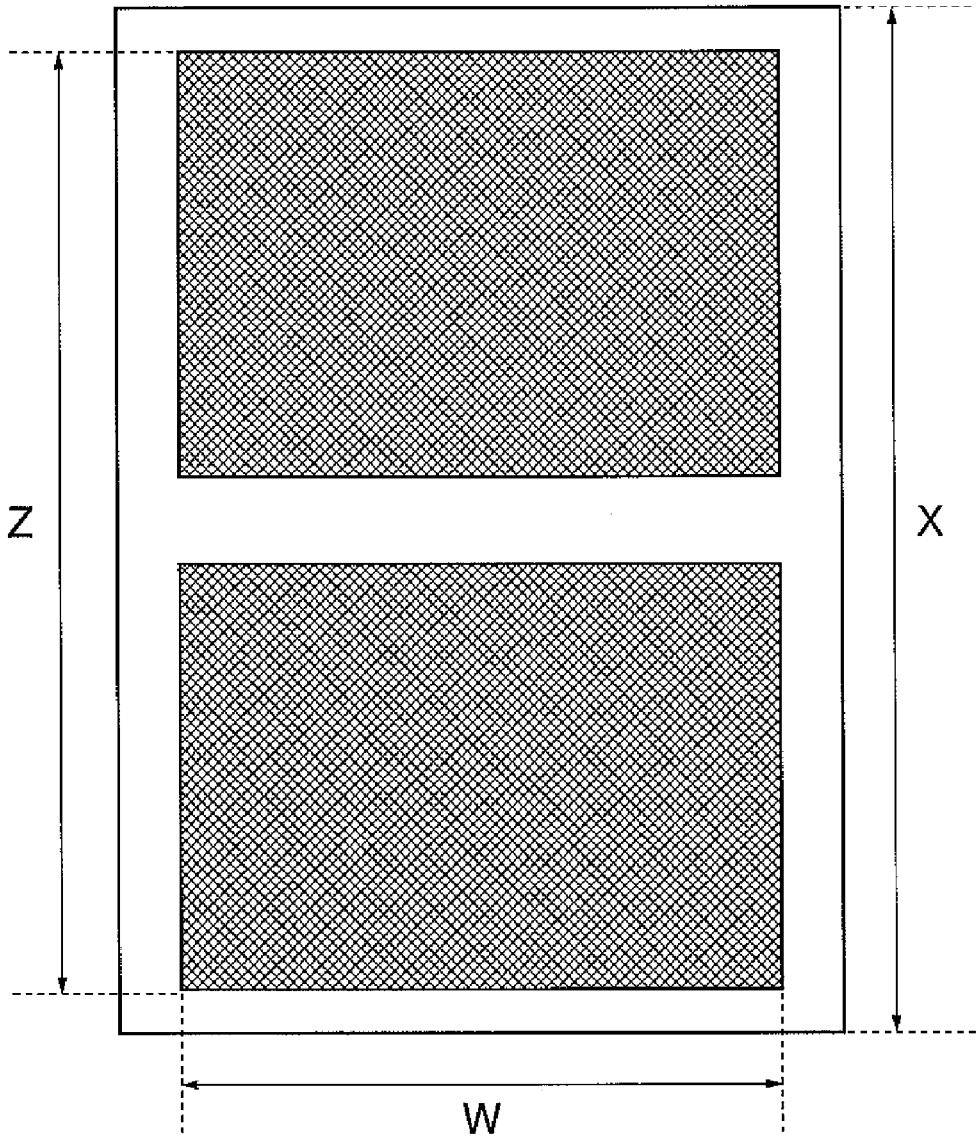
FIG. 9 is a view showing a case in which there is no image at a folding position when in a folding mode of the bookbinding apparatus shown in FIG. 1.

FIG. 9 is a view showing an image of a printed image in a case in which there is no toner image in the vicinity of the center of a folding position when expanding an image in the image forming apparatus in a case where a mode including a folding mode has been designated by the operation unit.

In this case, an instruction informing that formation of a clear coating image is unnecessary is transferred from the image forming apparatus 100 to the clear coating apparatus 200, and thus a clear coating image is not formed in the vicinity of the center of the folding position.

In this connection, even if a clear coating image is formed at the folding position of a sheet, there is a risk that the layer of clear toner will break when the sheet is folded. Therefore, the clear toner used in the present invention is preferably a resilient toner that includes resin.

As described above, by forming a clear coating image only at a folding position of a sheet, it is possible to coat a sheet with clear toner to prevent toner from coming off while reducing the amount of consumption of the clear toner. Further, because a clear toner is used, an appearance of an image formed by colored toner is not disturbed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-153666 filed Jun. 1, 2006, which is hereby incorporated by reference herein in its entirety.

What is claimed is:

1. An image forming system comprising:

an image forming apparatus adapted to form an image on at least one sheet;

a clear coating apparatus adapted to form a clear coating image on the at least one sheet using a clear toner that becomes transparent after fixing;

a bookbinding apparatus that is connected to said image forming apparatus and said clear coating apparatus, and that is adapted to fold the at least one sheet; and a controller adapted to cause said clear coating apparatus to form the clear coating image at a folding position on the at least one sheet in response to designation of a folding mode in said bookbinding apparatus, wherein said controller controls said clear coating apparatus so as to form the clear coating image only at the folding position of the at least one sheet as a front cover of a book that is bound by said bookbinding apparatus.

2. The image forming system according to claim 1, wherein said controller generates clear coating image data and transfers the clear coating image data to said clear coating apparatus such that the clear coating image is formed only at the folding position of the at least one sheet.

3. The image forming system according to claim 1, wherein, when the folding mode is designated, said controller determines the folding position of the at least one sheet, determines an image frame in said clear coating apparatus such that the clear coating image is formed only at the folding position of the least one sheet, and controls said clear coating apparatus so as to form the clear coating image within the image frame without any image data from said image forming apparatus.

4. An image forming system comprising:

an image forming apparatus adapted to form an image on at least one sheet;

a clear coating apparatus adapted to form a clear coating image on the at least one sheet using a clear toner that becomes transparent after fixing;

a bookbinding apparatus that is connected to said image forming apparatus and said clear coating apparatus, and that is adapted to fold the at least one sheet; and a controller adapted to cause said clear coating apparatus to form the clear coating image at a folding position on the at least one sheet in response to designation of a folding mode in said bookbinding apparatus, wherein said controller controls said clear coating apparatus so as to form the clear coating image only at the folding position of one sheet as a front cover and the clear coating image only at a folding position of another sheet as an innermost page of a book that is bound by said bookbinding apparatus.

5. The image forming system according to claim 1, wherein, when the image is not formed by said image forming apparatus at the folding position of the at least one sheet, said controller controls said clear coating apparatus so as not to form the clear coating image at the folding position of the at least one sheet.

* * * * *